US006149149A

United States Patent [19]

Gämmerler et al.

[11] Patent Number: 6,149,149

[45] Date of Patent: Nov. 21, 2000

[54] CROSS STACKER

[75] Inventors: Hagen Gämmerler, Icking; Peter Kunz, Geretsried, both of Germany

[73] Assignee: Gammerler AG, Geretsried-Gelting, Germany

[21] Appl. No.: 09/128,118

[22] Filed: Aug. 3, 1998

[30] Foreign Application Priority Data

Aug. 4, 1997 [DE] Germany ..... 197 33 705
Jan. 5, 1998 [DE] Germany ..... 198 00 162

[51] Int. Cl.[7] ..... B65H 31/12

[52] U.S. Cl. ..... 271/218; 271/213; 414/788.6; 414/790.8; 414/792.4; 414/794.1; 414/794.2

[58] Field of Search ..... 271/215, 217, 271/218, 213; 414/788.6, 790.8, 791, 791.2, 792.2, 792.3, 792.4, 792.5, 794.1, 794.2

[56] References Cited

U.S. PATENT DOCUMENTS

| | | | |
|---|---|---|---|
| 2,819,661 | 1/1958 | Howdle et al. | 414/790.8 |
| 3,006,258 | 10/1961 | Jochem | 414/790.8 |
| 3,027,817 | 4/1962 | Loeffler | 414/790.8 |
| 4,189,270 | 2/1980 | Ehrlich . | |
| 4,934,687 | 6/1990 | Hayden et al. . | |
| 5,328,323 | 7/1994 | Molison . | |
| 5,388,746 | 2/1995 | Hatchell et al. . | |

FOREIGN PATENT DOCUMENTS

| | | | |
|---|---|---|---|
| 586802 | 3/1994 | European Pat. Off. . | |
| 626330 | 11/1994 | European Pat. Off. . | |
| 1228275 | 11/1966 | Germany . | |
| GM 72 36 337 | 4/1973 | Germany | A41D 27/00 |
| 27 42 983 A1 | 4/1978 | Germany | B65H 33/08 |
| 93 17 919 U1 | 5/1994 | Germany | B65H 31/32 |
| 9317919 | 5/1994 | Germany . | |
| 19615009 A1 | 10/1997 | Germany . | |
| 57-131663 | 8/1982 | Japan . | |
| 1162454 | 8/1969 | United Kingdom . | |
| 1 283 729 | 8/1972 | United Kingdom | B65H 31/08 |
| 2 143 201 | 2/1985 | United Kingdom | B65H 33/02 |

OTHER PUBLICATIONS

German Search Report dated Dec. 9, 1997, for DE Application No. 197 33 705.8, with English–language translation (10 pages).

*Primary Examiner*—H. Grant Skaggs
*Attorney, Agent, or Firm*—Fitch, Even, Tabin & Flannery

[57] ABSTRACT

A cross stacker for paper products comprises a first reception element (16) on which the paper products to be stacked are collected and a further reception element (18). A rotation device (12, 14) is arranged beneath the reception elements. At least the further reception element (18) is formed so as to be vertically displaceable.

13 Claims, 2 Drawing Sheets

CROSS STACKER

Figure 1:
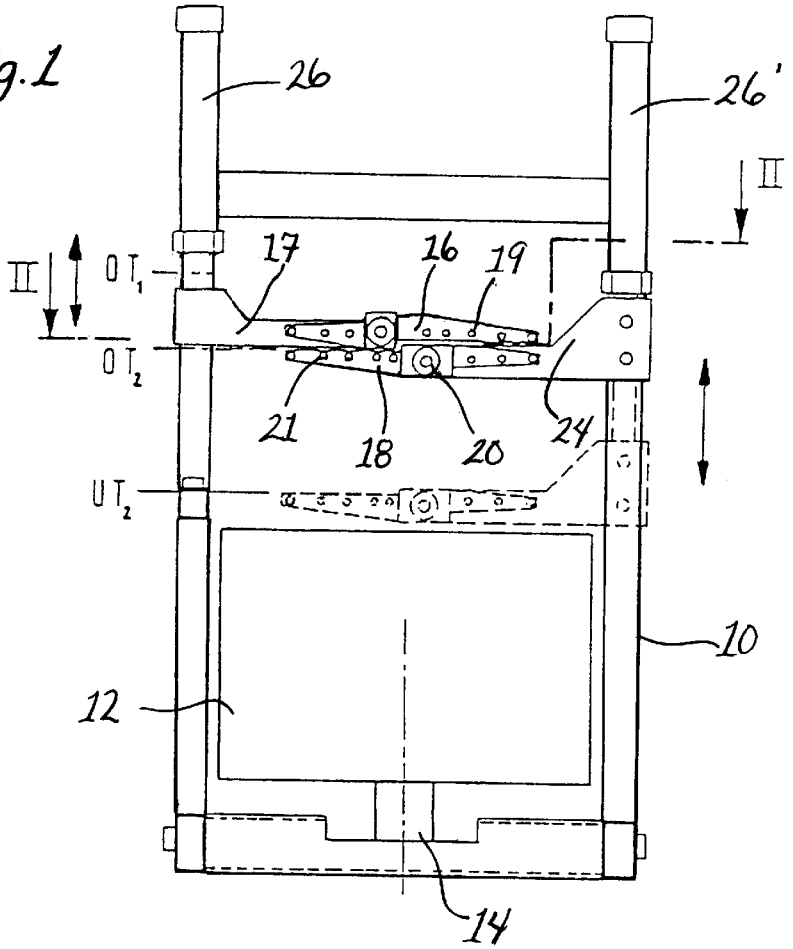

The present invention relates to a cross stacker for paper products in accordance with the preamble of claim 1.

Cross stackers of this kind are known in principle and serve to form individual paper products, for example journals, advertising brochures, newspapers and the like, into a stack which contains substacks which are displaced by 180°. Since printing products usually have a fold, a stacking of the printing products with a displacement of 180° is required in order that the orientation of the stack is maintained even in higher product stacks.

In the known cross stackers the product flow, which is delivered in scale formation, is forwarded onto a first reception element in the form of a grating, through which a first substack is formed. One or more further gratings are arranged beneath this grating, with all gratings being stationary in the vertical direction. After the product stack which is located on the upper grating has reached a certain height, this grating, which is designed in two parts, is opened, through which the product stack falls onto the grating lying below it. After a further height increase of the stack through the supply of printing products this grating is also opened, through which the product stack falls onto a further grating or into a rotation basket, which rotates the stack located therein by 180°.

The problem (object) lying at the basis of the invention is to improve a cross stacker of the initially named kind in such a manner that a careful stack formation takes place in which the stacked products retain their peripheral contour.

The solution of this problem takes place through the features of claim 1, and in particular in that at least the further reception element is designed to be vertically displaceable. In accordance with the invention it is proposed to provide at least one, preferably two lowerable reception elements in a cross stacker in order to achieve a careful product conveyance, that is, a product conveyance in which each stack or partial stack respectively is transferred in such a manner that it substantially retains its peripheral contour without individual products shifting or being displaced. In accordance with the invention the partial stack which is formed on the first reception element can be transferred to the rotation device with a very small fall height. In addition no transfer is required after the formation of the product stack before the latter falls into the rotation device. Thus with only two reception elements a small fall height can be achieved without an intermediate transfer of the stack, so that the product stack which is formed retains its outer contour.

Advantageous embodiments of the invention are described in the description, in the drawings and in the subordinate claims.

In accordance with a first advantageous embodiment the vertically displaceable reception elements consist of two halves, which can be moved apart horizontally. For example two gratings which can be forwarded towards one another can be provided. An embodiment of this kind of a reception element, which is admittedly already known in principle, enables an exceptionally careful treatment of the stack in combination with the lowerability at high processing speeds.

The upper dead centre of the first reception element advantageously lies directly beneath a supply device of the paper products so that the paper products to be stacked are collected directly and with small fall height on the first reception element, with it being possible for a slight lowering of the first reception element to take place already during the collection of the paper product. Alternatively, it is however also possible to arrange the upper dead centre not directly beneath the supply device. In this case the space provided can be used as a preliminary collection region.

The lower dead centre of both reception elements can be the same, so that both reception elements alternatingly receive and forward a stack, with it being possible to optimise the operating time for the lifting and the lowering of the reception elements.

The lower dead centre of the further reception element can lie directly above a following, further reception element or directly above the rotation device so that here as well a small fall height is given.

It is particularly advantageous when in all only a first and a further reception element are provided, since here the constructional cost and complexity are minimised; and product stacks which retain their outer contour during the stacking and the cross stacking can be formed in a careful manner with a total of only two reception elements.

In the method in accordance with the invention for the cross stacking of paper products the initially described advantages are likewise achieved. In this the reception elements can be lowered and lifted continually or step-wise in accordance with the invention. The reception elements are preferably lowered and lifted in response to a sensor signal which is produced by a sensor, for example by a light barrier or a micro-switch. Through this the cross stacking can also be carried out ideally in the cross stacking of products with different thickness, since the formation of the partial stacks within the cross stacker can be done in a sensor controlled manner.

In addition to setting cylinders, motors can also be used as drive elements, with it being possible for the torque transmission to take place via toothed belts, toothed bars, threaded spindles or chains.

Figure 2:
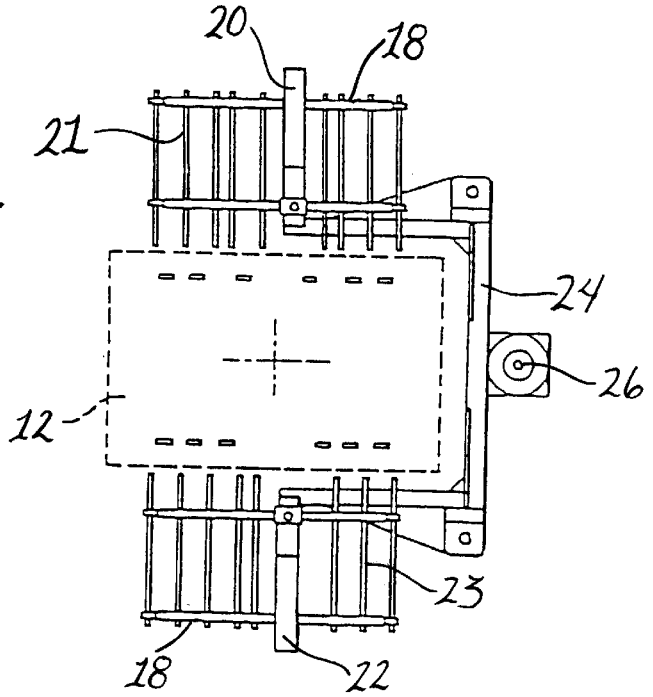

The present invention will be described in the following in a purely exemplary manner with reference to an advantageous embodiment and with reference to the accompanying drawings. Shown are:

FIG. 1 a cross-section through a first embodiment of a cross stacker;

FIG. 2 a cross-sectional view along the line II—II of FIG. 1; and

Figure 3:
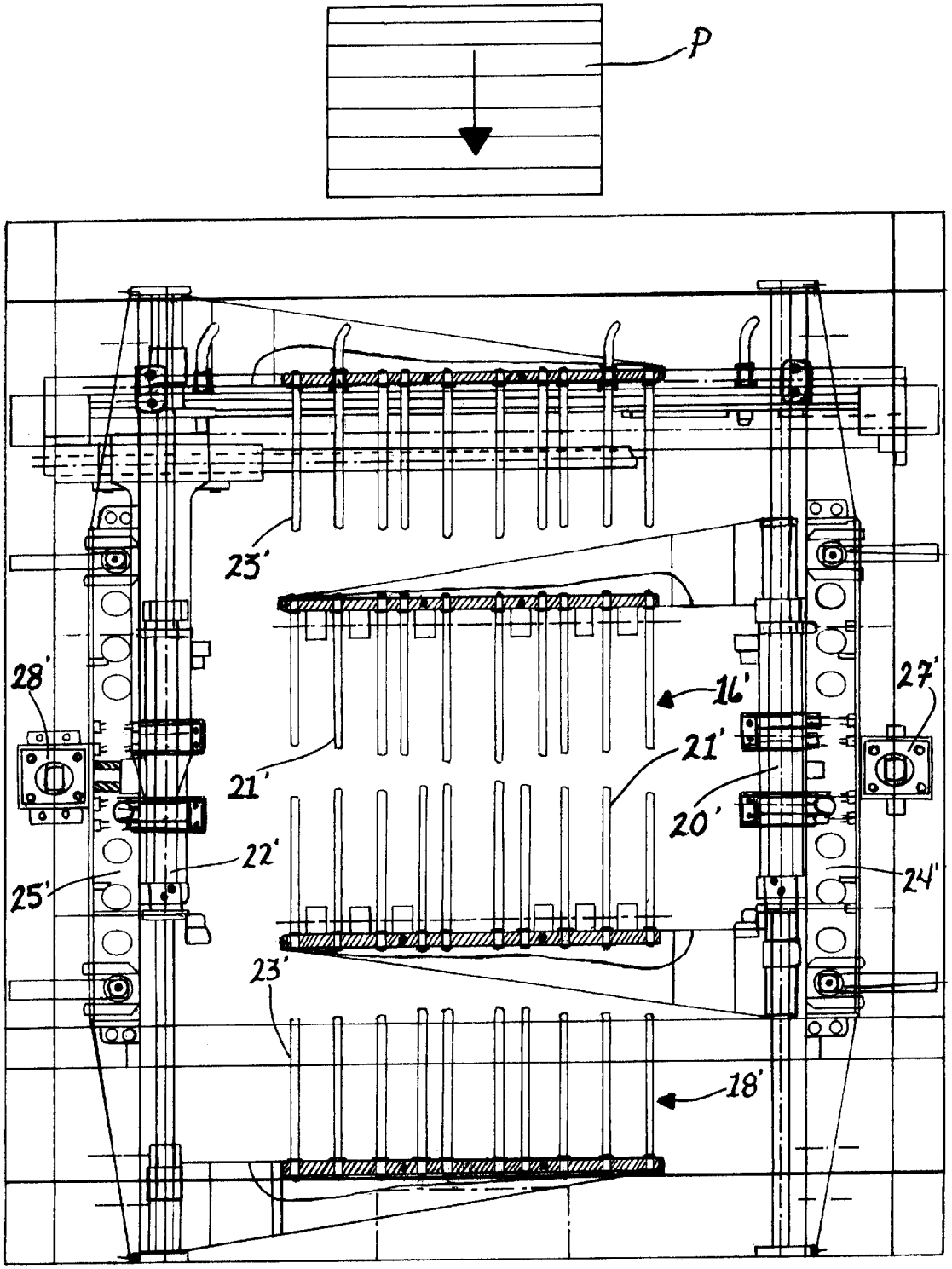

FIG. 3 a plan view of a further embodiment of a cross stacker.

The cross stacker for paper products which is illustrated in FIGS. 1 and 2 consists of a base frame 10, at the base of which a rotation basket 12 is mounted on a shaft 14. The rotation basket 12 can be rotated about the shaft 14 by 180°.

In the upper region of the cross stacker a first reception element is provided in the form of a grating 16 which is fastened by a mounting angle 17 to a setting cylinder 26, which enables a vertical displacement of the first reception element 16, which is fastened thereto. The grating 16 is built up in two parts and has individual prongs 19 which extend perpendicularly out of the plane of the drawing in FIG. 1.

The two halves of the grating 16, of which only one is illustrated in FIG. 1, can be moved in the horizontal direction by setting cylinders, i.e. the two halves can be moved toward one another and away from one another so that a closed reception surface can be formed from the prongs of the two grating halves, which however can be opened through a moving apart of the two grating halves, so that a stack which is located thereon falls downwardly. In FIG. 1 the movement of the two grating halves takes place perpendicular to the plane of the drawing.

Beneath the first reception element 16 a further reception element 18 is provided which is formed in the same manner as the first reception element 16 and is fastened by a mounting angle 24 to a setting cylinder 26', which enables a vertical displacement of the further reception element 18, which is fastened thereto.

FIG. 2 shows a plan view of the further reception element 18 in the opened state. As can easily be recognised the further reception element 18 consists—as does the first reception element 16—of two halves with prongs 21, 23 which can be moved in the horizontal direction via setting cylinders 20, 22. The opening width of the two grating halves is dimensioned in such a manner that a product stack which is located on the reception element 18 can fall freely into the rotation basket 12 located below it after the two grating halves have been pulled apart.

In FIG. 1 the upper dead centre of the first reception element 16 is designated by $OT_1$ and the upper dead centre of the further reception element 18 is designated by $OT_2$, whereas its lower dead centre is designated by $UT_2$. This lower position of the further reception element 18 is illustrated in broken lines in FIG. 1. In this situation the upper dead centre $OT_2$ of the reception element 18 illustrated in the drawing lies directly beneath the first reception element 16, which is moved in the product transfer position in FIG. 1. Depending on the desired stack height, however, any desired transfer point can be approached by the reception elements 16, 18.

In order to enable as small a distance as possible between the first reception element 16 and the further reception element 18 in a product transfer, the setting cylinders of the first reception element 16 and the setting cylinders 20, 22 of the second reception element 18 are arranged so as to be slightly mutually displaced in the horizontal.

During the operation of the cross stacker in accordance with the invention the printed products, which are delivered in scale formation (in FIG. 1 perpendicular to the plane of the drawing), are forwarded onto the first reception element 16, which is closed, so that a first partial stack forms. When a certain stack height is reached, a lowering of the first reception element 16 takes place via the setting cylinder 26. Then the two grating halves of the first reception element 16 open so that the stack falls onto the further reception element 18, which is located directly below it, and which is closed. In this an extremely short distance must be travelled.

Afterwards the two grating halves of the first reception element 16 remain open and the further reception element 18 is lowered continually or step-wise via the setting cylinder 26'. At the same time the first reception element 16 is lifted up to the upper dead centre $OT_1$. When the lower dead centre $UT_2$ is reached the two grating halves of the further reception element 18 are opened. During this a further stack can be formed on the first reception element 16, which has been closed in the mean time, whereas the stack which was previously formed on the further reception element 18 falls into the rotation basket 12. During the stack formation on the first reception element 16 the further reception element 18 can be closed and be moved up to the transfer point. At the same time the rotation basket 12 can be rotated by 180° in order to effect the cross stacking. After the stack in the rotation basket 12 has reached the desired height, the latter is pushed laterally out of the rotation basket or is removed from the latter by means of a gripper apparatus.

Sensors are provided for the control of the reception elements 16, 18 which are for example arranged above the first reception element 16 in order to detect the achieving of a certain preliminary stack height. After the stack which is formed on the first reception element 16 has reached a certain height, a sensor element emits a signal in order to trigger a lowering and subsequent opening of the first reception element 16 and a successive lowering of the further reception element 18. The lowering of the reception elements 16, 18 can be done either continuously or in a clocked manner, with advantages in the excitation being achieved in the case of a clocked lowering.

In accordance with a further embodiment, which is illustrated in FIG. 3, a movement sequence is possible in which the reception elements open in each case to such an extent that they can be led outwardly past one another, through which they alternatingly and cyclically receive the products, lower and deposit them. FIG. 3 shows a plan view of this alternative embodiment of a cross stacker, with identical, yet primed, reference symbols being used for similar components.

The cross stacker for paper products illustrated in FIG. 3 has a first reception element 16' in the form of a grating which consists of two halves which are formed by prongs 21'. The two halves of the reception element 16' can be moved toward one another and away from one another via setting cylinders 20' so that a substantially closed reception surface can be formed from the prongs of the two grating halves which can be opened through a moving apart of the two grating halves, that is, through an activation of the setting cylinder 20', so that a stack which is located thereon falls downwardly. The reception element 16' is fastened by a mounting angle 24' to a further setting cylinder 27', which enables a vertical displacement of the reception element 16'.

The cross stacker illustrated in FIG. 3 has a further reception element 18' which is formed in the same manner as the first reception element 16'. Both reception elements 16' and 18' have an opening width which is such that the respective other reception element can be passed through in the closed state between the two halves of the one reception element, as is illustrated in FIG. 3. Both reception elements 16' and 18' are vertically displaceable or movable respectively through the setting cylinders 27' and 28' from a reception position directly beneath a supply device for paper products to an output position directly above the rotation basket.

In the embodiment illustrated in FIG. 3 the product flow, which is designated with P in FIG. 3, is first forwarded onto the first reception element 16', which is arranged directly beneath this supplied product flow in the closed state. Then the reception element 16' is lowered, through which a stack forms on the latter. After this stack has reached a desired height the reception element 16' is lowered in an accelerated manner with the help of the setting cylinder 27'. At the same time the further reception element 18', which has been placed in the reception position, is closed so that a further stack can be formed on the latter. After the first reception element 16' has reached the output position directly above the rotation basket 12, the former is opened so that the stack falls into the rotation basket. The rotation basket is then rotated by 180°.

The reception element 16' is then moved in the open state up to the upper reception position and then closed again when the stack which has formed on the further reception element has reached the desired height. In this embodiment the speeds of the two reception elements relative to one another can be varied in an advantageous manner.

In principle the collection process of one layer can already be ended before the lowering movement begins, i.e. the lowering procedure can serve for the collection and/or for the downward transport of a finished layer.

In order to achieve a clean dipping in of the gratings into the supplied product flow the scale flow is briefly stopped by a separation device during the change of the reception elements.

What is claimed is:

1. A cross stacker for paper products comprising:

a first reception element on which the paper products to be stacked are collected and which is vertically displaceable;

at least one further reception element that is vertically displaceable; and a rotation device arranged beneath the reception elements;

wherein the first and the further reception element each include two halves which can be moved apart horizontally from a closed state to an open state, the respective halves of the first and further reception elements having an opening therebetween of a predetermined size such that with one of the first and further reception element in the open state thereof the other of the first and further reception element can be moved in its closed state through the opening between the halves of the one reception element.

2. A cross stacker according to claim 1, wherein an upper dead center of at least one reception element lies directly beneath a supply device of the paper products.

3. A cross stacker according to claim 1, wherein a lower dead center of at least one reception element lies directly above the rotation device.

4. A cross stacker according to claim 1, wherein the first and further reception elements comprise gratings.

5. A cross stacker according to claim 1, wherein exactly one first and one further reception element are provided.

6. A method for cross stacking paper products comprising:

forwarding a number of products of a product flow onto a first reception element;

lowering the first reception element and making a further reception element available above the first reception element;

closing and lowering the further reception element with additional products thereon;

opening the first reception element and transferring a product stack which is collected thereon into a rotation apparatus;

rotating the rotation apparatus and lifting the first reception element in an opened state;

closing the first reception element and further lowering the further element; and opening the further reception element and transferring the product stack on the further reception element into the rotation apparatus.

7. A method for cross stacking paper products comprising:

forwarding a number of products of a product flow onto a first reception element;

lowering the first reception element;

opening the first reception element and transferring a product stack to a further reception element lying below it;

lowering the further reception element;

lifting and closing the first reception element;

opening the further reception element and transferring the product stack into a rotation apparatus; and rotating the rotation apparatus and closing and lifting the further reception element.

8. A method for the cross stacking of paper products comprising:

forwarding a number of products of a product flow onto a first reception element;

opening the first reception element and transferring a product stack to a further reception element lying below it;

lowering the further reception element;

closing the first reception element;

opening the further reception element and transferring the product stack into a rotation apparatus; and rotating the rotation apparatus and closing and lifting the further reception element.

9. A method in accordance with claim 8, including the steps of lowering one or more of the reception elements in response to a sensor signal.

10. A method in accordance with claim 8, wherein one or more of the reception elements are lowered and. lifted continuously or in a clocked or controlled manner.

11. A system for cross stacking of signatures that provides high control over the signatures to maintain an orderly stacked configuration thereof during high speed signature transfer operations for formation of signature stacks, the cross-stacking system comprising:

a first signature receiving mechanism having a plurality of first support members, the first signature receiving mechanism being vertically displaceable;

a second signature receiving mechanism having a plurality of second support members that are aligned with the first support members, the first and second receiving mechanisms each having a closed state with the respective support members disposed to support signatures thereon and an open state with the respective support members disposed to allow the signatures thereon to fall therefrom such that with both first and second receiving mechanism in the closed state the receiving mechanisms cannot advance past each other due to interference between the aligned support members thereof;

a rotation device for receiving signatures from at least the second signature receiving mechanisms when shifted from the closed to the open state thereof;

a vertical displacement mechanism associated with the second signature receiving mechanism for shifting the second signature receiving mechanism between a raised, signature receiving position and a lowered, signature transferring position that minimize distances signatures fall onto the second receiving mechanism in the closed state thereof and from the second receiving mechanism to the rotation device in the open state thereof for maintaining control over the stack configuration.

12. The cross-stacking system of claim 11 wherein the first signature receiving mechanism includes a vertical displacement mechanism associated therewith for shifting the first signature receiving mechanism between a raised, signature receiving position and a lowered, signature transferring position that are both higher than the raised, signature receiving position of the second signature receiving mechanism with the lowered, signature transferring position of the first receiving mechanism being closely adjacent the raised, signature receiving position of the second receiving mechanism to minimize the distance signatures fall when the first receiving mechanism is shifted to its open state in the lowered, transfer position thereof.

13. The cross stacking system of claim 11 wherein the support members of each of the receiving mechanisms define an opening therebetween in the open state thereof that is of sufficient size such that with one of the receiving mechanisms in the open state the other of the receiving mechanisms shifted to the closed state can fit through the opening of the one receiving mechanism as the receiving mechanisms are shifted vertically relative to each other.

* * * * *